United States Patent [19]

Ui et al.

[11] Patent Number: 4,686,328

[45] Date of Patent: Aug. 11, 1987

[54] HERMETICALLY SEALED CONNECTOR FOR GLOVE BOX AND METHOD FOR EXCHANGING SUCH CONNECTORS

[75] Inventors: Masahito Ui; Hideo Akiyama; Akio Todokoro; Yukio Natsui; Hiroshi Kogure; Yujiro Kato; Tsuneo Ozaki, all of Ibaraki, Japan

[73] Assignees: Doryokuro Kakunenryo Kaihatsu Jigyodan; Hitachi Cable Ltd., both of Tokyo, Japan

[21] Appl. No.: 602,585

[22] Filed: Apr. 20, 1984

[30] Foreign Application Priority Data

Apr. 30, 1983 [JP] Japan ..... 58-76868

[51] Int. Cl.[4] ..... H01B 17/26

[52] U.S. Cl. ..... 174/153 R; 285/161; 312/1; 439/272

[58] Field of Search ..... 285/161, 192, 196, 205, 285/206, 158, 193; 174/74 R, 88 R, 153 R, 152 R, 151, 18, 65 SS; 312/1; 339/94 A

[56] References Cited

U.S. PATENT DOCUMENTS

| | | | |
|---|---|---|---|
| 839,665 | 12/1906 | Steinberger | 174/153 R |
| 1,030,306 | 6/1912 | Hull | 285/161 |
| 1,245,077 | 10/1917 | Webster | 285/161 X |
| 1,310,190 | 7/1919 | Horton | 285/161 X |
| 1,391,396 | 9/1921 | McMurtrie | 285/158 |
| 1,548,570 | 8/1925 | Wuesthoff | 285/200 X |
| 1,787,645 | 1/1931 | Sisk | 285/193 X |
| 1,966,731 | 7/1934 | Newman | 285/206 X |
| 2,277,885 | 3/1942 | Rodanet | 285/206 X |
| 2,438,412 | 3/1948 | Morris | 285/158 X |
| 2,461,414 | 2/1949 | Donner | 285/206 X |
| 2,672,500 | 3/1954 | Bondon | 174/153 R |
| 2,730,381 | 1/1956 | Curtiss | 285/161 X |
| 2,800,523 | 7/1957 | Sidenmark et al. | 174/88 R X |
| 3,401,958 | 9/1968 | Demyon | 285/161 X |
| 3,565,466 | 2/1971 | Mullings | 285/158 |
| 4,145,075 | 3/1976 | Holzmann | 285/161 X |
| 4,231,631 | 11/1980 | Guerinault et al. | 339/94 A |

FOREIGN PATENT DOCUMENTS

| | | | |
|---|---|---|---|
| 1081420 | 6/1954 | France | 174/153 R |

*Primary Examiner*—Thomas F. Callaghan

*Attorney, Agent, or Firm*—Sughrue, Mion, Zinn, Macpeak & Seas

[57] ABSTRACT

A hermetically sealed connector for a glove box and a method for exchanging such connectors in which leakage of radioactive material from within the glove box is minimized and an auxiliary glove box is not needed to exchange the connectors. The connector is formed as a cylindrical member having a flange portion hermetically sealed to a packing provided in a through hole in the wall of the glove box. To exchange connectors, a nut is removed from the outer end of the old connector and a tube is screwed thereto. The other end of the tube is fitted to the inner end of the new connector. The tube is then shoved through the packing until the flange of the new connector aligns with the packing. The tube is then removed from the inner end of the new connector and a nut is screwed on in replacement for the tube.

3 Claims, 10 Drawing Figures

HERMETICALLY SEALED CONNECTOR FOR GLOVE BOX AND METHOD FOR EXCHANGING SUCH CONNECTORS

BACKGROUND OF THE INVENTION

The invention pertains to a hermetically sealed connector especially adapted for use with a sealed glove box. Further, the invention pertains to a method for exchanging one such connector for another. Such connectors are typically used for electrically connecting devices disposed inside the glove box with devices outside the glove box. For instance, such a connector can be used to connect a motor inside the glove box with a power supply on the outside. The invention is particularly useful in a situation where the glove box contains a material such as a radioactive material which cannot be handled directly and must be manipulated from outside the box with the gloves.

As shown in FIG. 1, a glove box generally includes gloves 3 which the operator can employ to manipulate objects within the glove box from the outside. Bags 4 are provided for removing waste materials from the box and placing new materials inside the box. An intake filter 5 is provided through which air passes going into box, while air expelled from the box passes through an exhaust filter 6. Illumination is provided by a lighting device 7. A connector 8, to which the invention is most particulary concerned, is provided for providing electrical connections between the inside and outside of the box 1.

Each of the above-mentioned elements is mounted on a wall 2 of the box. Particularly, as shown in FIG. 2, the connector 8 is mounted on the outside wall 2 through stud bolts 10, the heads of which are welded to the box 1 around a through hole 9 provided the wall 2. A flange 11 of a housing 14 of the connector 8 is separated from the wall 2 by a packing 15. The bolt 10 passes through respective holes formed in a flange 11. Nuts 16 secure the flange 11 to the wall 2. Power supply cables 12 are sealed by a sealing material 13, for instance, a high polymer material such as epoxy resin, in the space between the cables 12 and the housing 14.

Sometimes, due to inevitable failures and damage, it is necessary to replace the connector 8. Conventionally, this has been done, as illustrated in FIG. 3, with the use of a second, smaller glove box 36. The box 36 has an open side which is placed against the outer wall 2 of the larger glove box 1 with the connector 8 contained therein. A flange of the box 36 is sealed to the wall 2 through a packing, double-sided tape, or the like. The operator can then insert his hand into the glove 3 and remove the nuts 16 from the bolts 10, thereby removing the connector 8 from the bolts 10. A new connector, which was placed in the box 36 before the box 36 was placed against the outer wall 2 of the box 1, is then secured with the bolts 10 and nuts 16. Thereafter, the old connector box 36 is moved away and the old connector disposed of.

In this conventional method of exchanging connectors, the atmospheres in the boxes 1 and 36 are in communication with one another during the period that no connector 8 is fitted to the bolts. Hence, the new connector can be contaminated by radioactive material. Also, radioactive material can be present in the atmosphere within the box 36, and hence can be scattered in the work room when the box 36 is removed from the wall 2.

Accordingly, it is an object to the present invention to provide a hermetically sealed connector for a glove box and a method for exchanging such connectors in which the drawbacks mentioned above have been eliminated.

SUMMARY OF THE INVENTION

In accordance with the above and other objects, the invention provides a hermetically sealed connector for a glove box having a central sleeve portion, through which the connecting wires pass, having on the surface thereof a flange portion of a diameter equal to or slightly greater than the diameter of a through hole in which the connector is to be mounted. The through hole in the wall of the glove box is provided with a sealing member along its outer periphery. The flange portion of the connector is aligned with the sealing member, and clamping members are disposed on opposite sides of the sealing member to rigidly fix the connector to the wall of the glove box.

To exchange such a connector, in accordance with the invention, a tube is provided having the same configuration at opposite ends as the clamping members. For instance, if the clamping members are nuts, the tube is threaded at opposite ends with screw threads of the same size and diameter as the nuts. The outer diameter of the tube should be substantially the same as the diameter of the flange portion of the sleeve portion of the connector. The outside one of the clamping members is removed from the old connector, and one end of the tube is fitted in its place. In the other end of tube is fitted the new connector. The tube is then forced through the sealing member, while maintaining sealing engagement with the sealing member, until the flange of the new connector is aligned with the sealing member in the through hole. Then, from the inside of the glove box, the tube is removed from the inside of the new connector, and a clamping member is inserted around the inside end of the connector to secure it to the wall.

DESCRIPTION OF THE PREFERRED EMBODIMENTS

Figure 1:
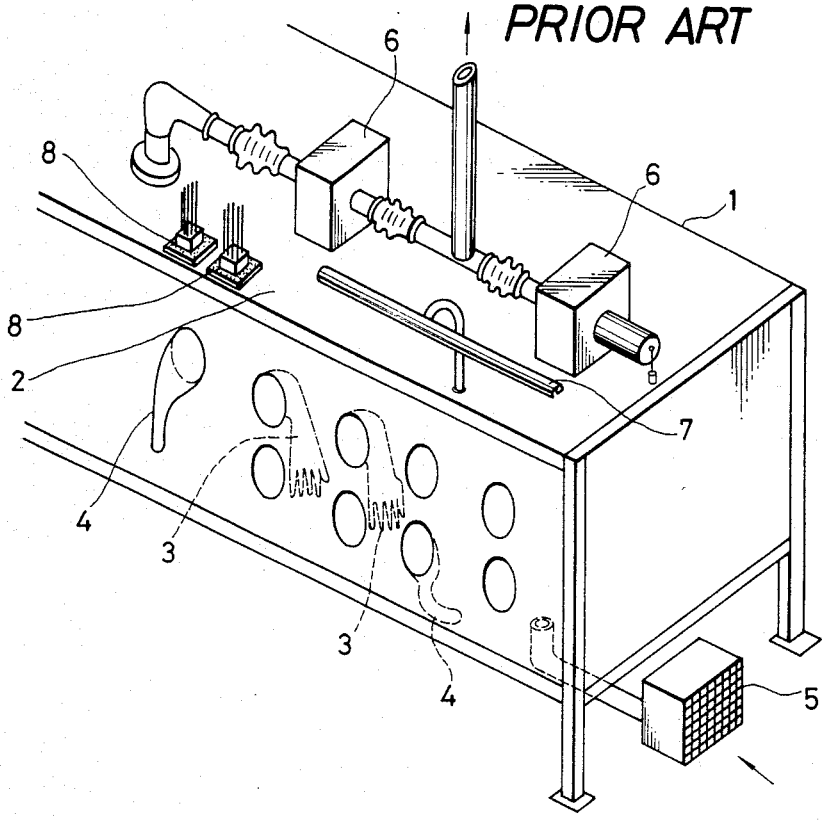
FIG. 1 PRIOR ART
FIG. 1 is a perspective view showing an example of a conventional glove box.
Figure 2:
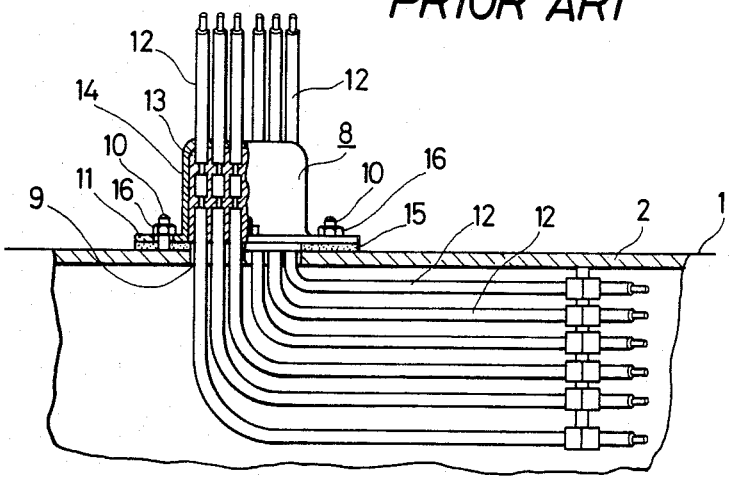
FIG. 2 PRIOR ART
FIG. 2 is a partially cross-sectional view of a connector used with the conventional glove box.
Figure 4:
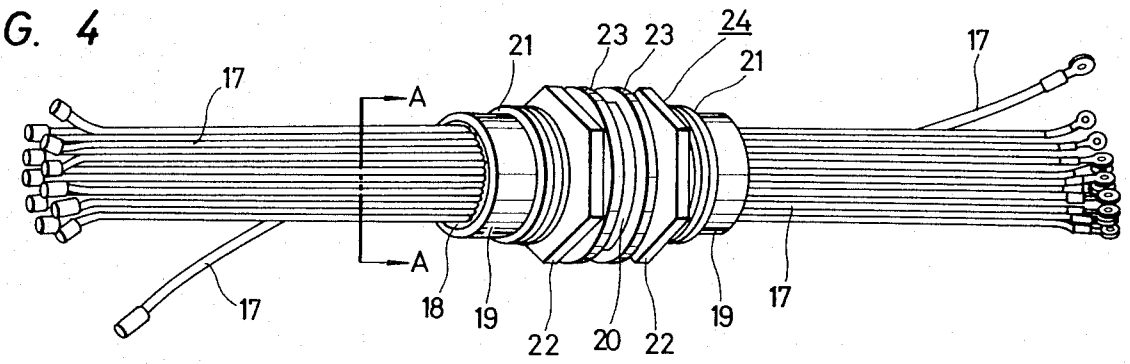
FIG. 4 is a perspective view showing a connector constructed in accordance with the invention.

Referring now to FIG. 4, there is shown therein a perspective view of a connector constructed in accordance with the present invention. The connector 24 includes a plurality of electrical lines 17 at either end for making connections to devices within the glove box 1 and to devices outside the box. The end of the wires 17 are sealed to a cylindrical casing 19 by a sealant 18 such as epoxy resin, bakelite resin, vinyl chloride resin, or ABS resin. The casing 19, which has a hollow cylindrical configuration, may be made of a hard material such as polyvinyl chloride resin. Integral with the casing 19 is a flange 20, having an outer diameter equal to or slightly greater than the diameter of the through hole 9. A pair of clamping members 22, which are here nuts threaded to the casing 19, are provided at the opposed ends of the casing 19. Washers 23 are also provided. The nuts 22 may be made of the same material as the casing 19.

Figure 5:
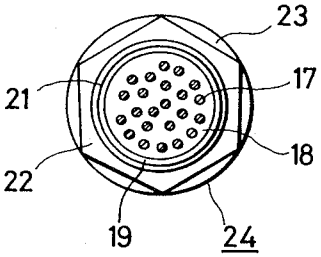
FIG. 5 is a cross-sectional view of the connector of FIG. 4 taken along a line A-A.
Figure 3:
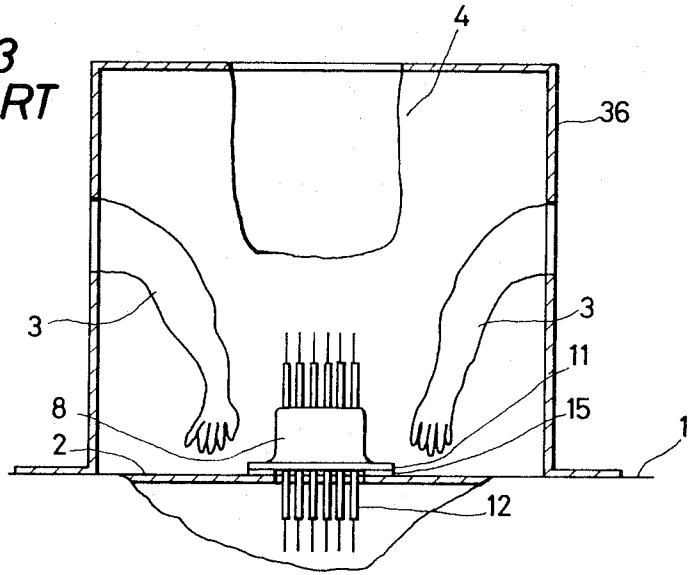
FIG. 3 PRIOR ART
FIG. 3 is a drawing depicting a conventional method of replacing a connector of the type shown FIG. 2.
Figure 6:
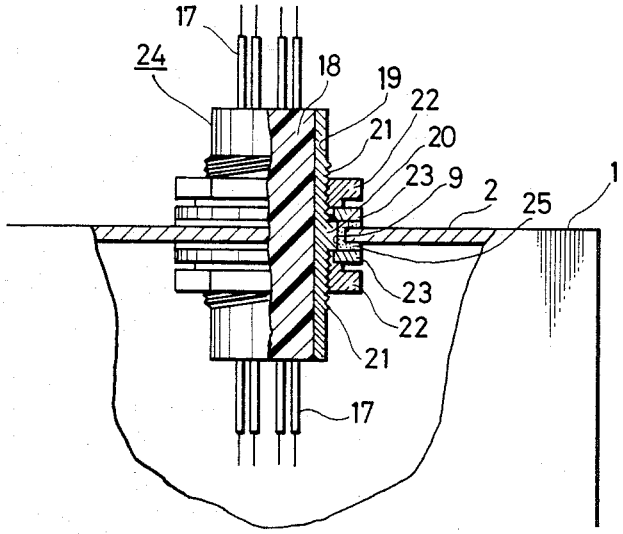
FIG. 6 is a partially cross-sectional view of the connector of FIG. 4 showing its mounting to the glove box.
Figure 7:
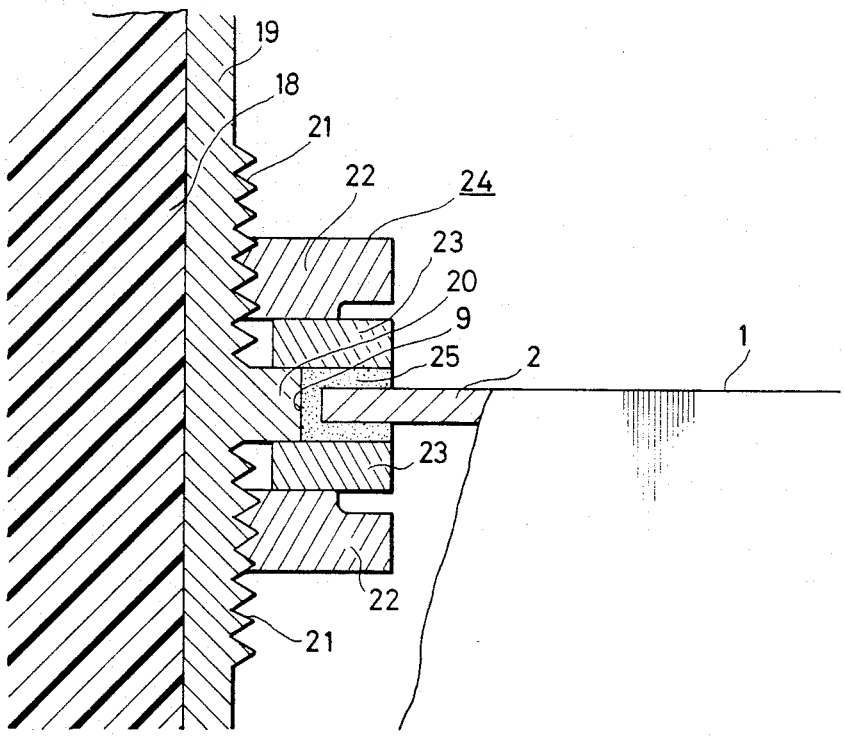
FIG. 7 is an enlarged cross-sectional view of a portion of FIG. 6.

The connector 24 of FIGS. 4 and 5 is mounted through the through hole of the glove box 2 in the manner illustrated in FIGS. 6 and 7. Particularly, a packing 25 made, for example, of chloroprene rubber and having an annular groove formed in the outer periphery thereof, is seated around the through hole 9. The connector 24 is fitted in the through hole 9 with the flange 20 in sealing engagement with the packing 25. The washers 23 and nuts 22 are then placed over and screwed on the casing 19 as shown in FIGS. 6 and 7. As seen in detail in FIG. 7, washers 23 sandwich the packing 25 and the flange 20 on opposite sides. This provides a good hermetic seal in the through hole 9.

Figure 8:
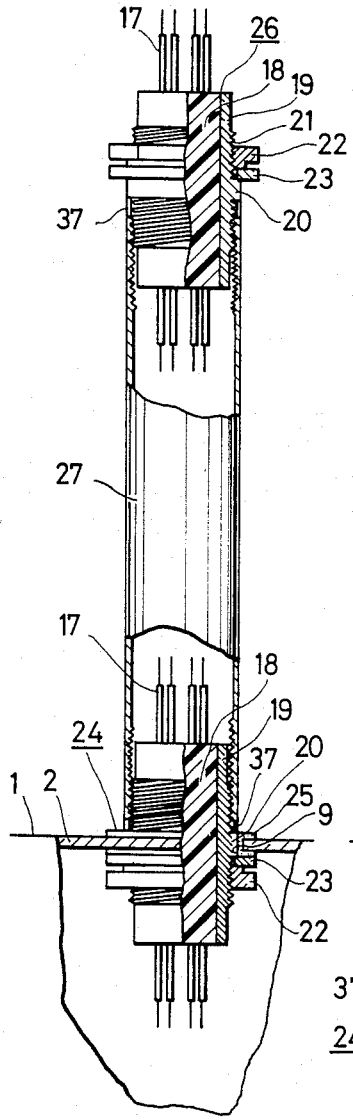
FIG. 8 and 9 are drawings, partially in cross section, illustrating a method of the invention of replacing a connector of the type shown in FIG. 4.
Figure 9:
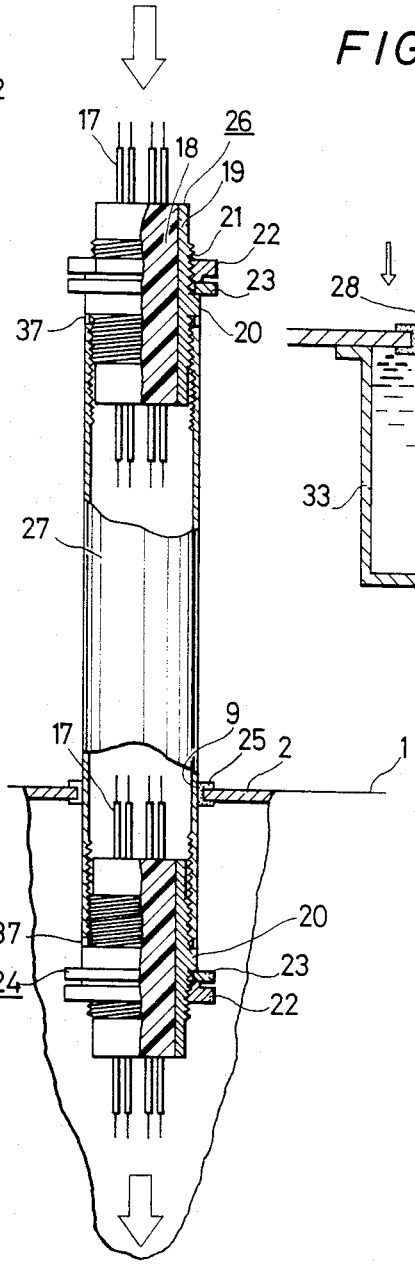

The connector 24 can be exchanged for another connector of the same configuration using a technique illustrated in FIGS. 8 and 9. First, as illustrated in FIG. 8, a new connector 26 having the washer 23 and nut 22 removed from one end thereof, is screwed into one end of a tube 27. For this purpose, the inner surface of the tube 27, at least at the ends thereof, is threaded with a screw thread corresponding in size to that of nuts 22. Then, the nut 22 and washer 23 on the outer end of the old connector 24 are removed, and then the outer end of the tube 27 is screwed onto the outer end of the old connector 24 as shown. In this process, a space between the old connector 24 and the new connector 26 in the tube 27 is hermetically sealed with flat packings 37 and 37 of ring configuration.

Then, as seen in FIG. 9, the entire assembly is shoved inwardly, with the outer surface of the tube 27 maintaining sealing engagement with the packing 25. The outer diameter of the tube 27 should, of course, be equal to or slightly larger than the inner diameter of the packing 25, and hence to the outer diameter of the flange 20. When the flange 20 of the new connector 26 is in alignment with the packing 25, from the inside of the box 1 and using the gloves 3 of the glove box 1, the tube 27 and the packing 37 are unscrewed from the inner end of the new connector 26. Then, a washer 23 is fitted over the inner end of the new connector 26 and a nut 22 screwed thereon. The tube 27 and old connector 24 can then be disposed of in the ordinary manner.

Figure 10:
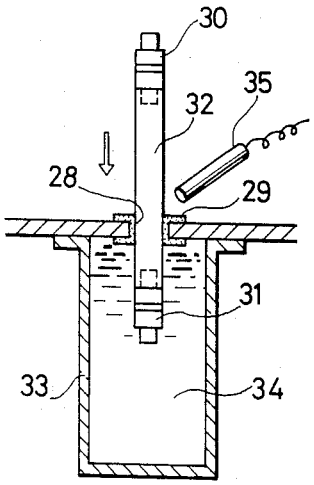
FIG. 10 is a drawing depicting a test carried out with the connector and method of the invention.

Tests were conducted to determine the amount of leakage from within the glove box 1 which could be expected to occur with the use of the method of the invention of replacing one connector for another. Specifically, as illustrated in FIG. 10, a reservoir 33 containing a refrigerant gas of a type which can easily be detected was placed around a through hole 28 formed in a wall. A packing 29 was fitted in the through hole 28. A tube 32 having connectors 30 screwed into both ends was forced through the packing 29 and the amount of leaking refrigerant was detected. It was determined that the amount of leaking refrigerant is less than $1\times10^{-5}$ atm-cc/sec. Thus, it was demonstrated that the connectors 30 and 31 can be exchanged without substantial leakage.

Modifications to the preferred embodiments described above are contemplated within the scope of the invention. For instance, the sealant 18 and the casing 19, including the external threaded portion of 21 and flange 20, can be formed as an integral unit. Further, although it is preferred that the casing 19, nuts 22 and washers 23 be made of a hard plastic material such as polyvinyl chloride resin because such a material has a very high insulating resistance and can easily be processed as waste, it is possible to use metal in place thereof. Still further, although it has been described above that the clamping members are formed by nuts, washers and threaded portions, other interlocking devices can be used instead.

As described above, in accordance with the present invention, it is not necessary to provide a separate glove box to exchange one connector for another. Also, the amount of leakage when the present invention is employed to exchange connectors is markedly less than that of the conventional approach. Moreover, the invention is advantageous in that it is not necessary to weld stud bolts to the glove box.

This completes the description of the preferred embodiments of the invention. Although preferred embodiments have been described, it is believed that numerous modifications and alterations thereto would be apparent to one of ordinary skill in the art without departing from the spirit and scope of the invention.

We claim:

1. A hermetically sealed connector device for a glove box for hazardous material comprising: a central cylindrical member 19 having electrical wires 17 passing therethrough; a flange portion 20 provided integrally with said central cylindrical member at a point between the ends of the cylindrical member, said flange portion having an outer diameter greater than the outer diameter of the other portions of said cylindrical member; a sealing member 25 adapted to be in hermetically sealing contact with the interior of a through hole of said glove box, said sealing member having an inner diameter equal to or slightly smaller than an outer diameter of said flange portion; and removable clamping members to be located at opposite ends of said flange portion for clamping and affecting a removable hermetic seal between the outer circumferential surface of said flange portion and the inner circumferential surface of said sealing member.

2. The connector device of claim 1, wherein said clamping members comprise a pair of washers disposed on opposite sides of said sealing member having an outer diameter greater than an inner diameter of said sealing member, and a pair of nuts threadedly engaged with said central cylindrical member and pressing said washers against said sealing member.

3. The connector device of claim 2, wherein said central cylindrical member, said nuts and said washers are formed of a hard plastic material.

* * * * *